US010306947B2

(12) United States Patent
Pratt et al.

(10) Patent No.: US 10,306,947 B2
(45) **Date of Patent: *Jun. 4, 2019**

(54) RAPID-ENTRY FOOTWEAR WITH REBOUNDING FIT SYSTEM

(71) Applicant: FAST IP, LLC, Alpine, UT (US)

(72) Inventors: Michael James Pratt, Alpine, UT (US); Steven Hermann, Saratoga Springs, UT (US); Seth Lytle, Pleasant Grove, UT (US); James Kuangcheng Tsen, Needham, MA (US)

(73) Assignee: FAST IP, LLC, Alpine, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/690,679

(22) Filed: Aug. 30, 2017

(65) Prior Publication Data

US 2017/0360143 A1 Dec. 21, 2017

Related U.S. Application Data

(63) Continuation of application No. 15/493,582, filed on Apr. 21, 2017, now Pat. No. 9,820,527.
(Continued)

(51) Int. Cl.
*A43B 3/24* (2006.01)
*A43B 23/02* (2006.01)
(Continued)

(52) U.S. Cl.
CPC ..... *A43B 3/248* (2013.01); *A43B 11/00* (2013.01); *A43B 23/027* (2013.01);
(Continued)

(58) Field of Classification Search
CPC ..... A43B 3/101; A43B 3/102; A43B 11/00; A43B 23/08; A43B 23/088; A43B 23/10; A43B 23/105; A43B 3/122; A43B 23/26
(Continued)

(56) References Cited

U.S. PATENT DOCUMENTS 112,439 A * 3/1871 Francis ..... A43B 3/16 36/7.3
808,948 A 1/1906 Roberts et al.
(Continued)

FOREIGN PATENT DOCUMENTS

CN 2438353 7/2001
CN 1403041 3/2003
(Continued)

OTHER PUBLICATIONS

Restriction Requirement dated Jan. 2, 2015 in U.S. Appl. No. 13/509,780.
(Continued)

*Primary Examiner* — Katharine Gracz
(74) *Attorney, Agent, or Firm* — Snell & Wilmer L.L.P.

(57) ABSTRACT

A rapid-entry and rebounding fit shoe having one or both of a rapid-entry heel element and a rapid-entry tongue element and both snap back for fit. The rapid-entry shoe directs a user's foot into or otherwise accommodates a user's foot with respect to, a shoe opening, and thereafter secures a rear portion of rapid-entry shoe about a user's heel as well as forefoot.

6 Claims, 14 Drawing Sheets

Related U.S. Application Data

(60) Provisional application No. 62/368,497, filed on Jul. 29, 2016, provisional application No. 62/326,650, filed on Apr. 22, 2016.

(51) Int. Cl.
*A43B 23/26* (2006.01)
*A43B 23/08* (2006.01)
*A43B 23/28* (2006.01)
*A43B 11/00* (2006.01)

(52) U.S. Cl.
CPC ..... *A43B 23/028* (2013.01); *A43B 23/0275* (2013.01); *A43B 23/088* (2013.01); *A43B 23/26* (2013.01); *A43B 23/28* (2013.01)

(58) Field of Classification Search
USPC ..... 36/58.5, 58.3
See application file for complete search history.

(56) References Cited

U.S. PATENT DOCUMENTS 827,330 A 7/1906 Tillson
863,549 A * 8/1907 Metz ..... A43B 23/28 36/58.5
881,153 A * 5/1908 Rickert ..... A43B 3/16
921,461 A * 5/1909 Rickert ..... A43B 3/16
923,860 A * 6/1909 Kroell ..... A43B 23/26 36/54
1,081,678 A 12/1913 Langerak
1,116,462 A * 11/1914 Moran ..... A43B 3/16 36/58.5
1,464,342 A * 8/1923 Rothacher ..... A43C 11/004 36/58.5
1,494,236 A 5/1924 Greathouse
1,686,175 A 10/1928 Read
1,926,818 A * 9/1933 Rateliff ..... A43B 23/28 36/58.5
2,069,752 A * 2/1937 Dorr ..... A43B 3/102 36/11.5
2,266,732 A 4/1940 Babinchak
2,368,514 A 1/1945 Baehr
2,450,250 A 3/1945 Napton
2,452,502 A 4/1945 Tarbox
2,736,110 A * 2/1956 Hardimon ..... A43B 11/00 36/58.5
2,763,071 A * 9/1956 Napier ..... A43B 5/1691 36/105
2,920,402 A * 1/1960 Minera ..... A43B 3/102 36/58.5
3,000,116 A 9/1961 Ally
3,146,535 A * 9/1964 Owings ..... A43B 1/0018 36/138
4,489,509 A 12/1984 Libit
4,590,690 A 5/1986 Pfander
4,811,502 A 3/1989 Barret
4,972,613 A 11/1990 Loveder
5,054,216 A * 10/1991 Lin ..... A43B 3/00 36/138
5,181,331 A 1/1993 Berger
5,184,410 A 2/1993 Hamilton
5,282,327 A * 2/1994 Ogle ..... A43B 11/00 36/105
5,341,583 A 8/1994 Hallenbeck
5,351,583 A 8/1994 Hallenbeck
5,371,957 A 12/1994 Gaudio
5,467,537 A 11/1995 Aveni et al.
5,481,814 A 1/1996 Spencer
5,842,292 A 12/1998 Siesel
6,125,555 A 10/2000 Schenkel
6,189,239 B1 2/2001 Gasparovic et al.
6,360,454 B1 * 3/2002 Dachgruber ..... A43B 5/0401 36/117.1
6,378,230 B1 4/2002 Rotem et al.
6,684,533 B1 2/2004 Su
6,938,361 B2 * 9/2005 Su ..... A43B 11/00 36/105
7,103,994 B2 9/2006 Johnson
7,178,270 B2 2/2007 Hurd et al.
7,225,563 B2 6/2007 Chen
7,439,837 B2 10/2008 McDonald
7,685,747 B1 3/2010 Gasparovic et al.
7,793,438 B1 9/2010 Busse et al.
7,823,299 B1 11/2010 Brigham
7,975,403 B2 7/2011 Mosher
D648,512 S 11/2011 Schlageter
8,065,819 B2 11/2011 Kaufman
8,161,669 B2 4/2012 Keating
8,225,535 B2 7/2012 Dillenbeck
8,499,474 B2 * 8/2013 Kaufman ..... A43C 11/00 36/50.1
8,769,845 B2 7/2014 Lin
9,615,624 B2 4/2017 Kilgore et al.
9,820,527 B2 11/2017 Pratt et al.
9,877,542 B2 * 1/2018 Pratt ..... A43B 11/00
2002/0144434 A1 * 10/2002 Farys ..... A43B 23/26 36/54
2005/0039348 A1 2/2005 Raluy et al.
2007/0074425 A1 4/2007 Leong
2008/0086911 A1 4/2008 Labbe
2008/0307673 A1 12/2008 Johnson
2011/0016751 A1 1/2011 Somerville
2011/0146106 A1 6/2011 Kaufman
2012/0216429 A1 8/2012 Bastida et al.
2012/0317839 A1 12/2012 Pratt
2013/0185959 A1 7/2013 Coleman
2013/0219747 A1 * 8/2013 Lederer ..... A43B 7/085 36/54
2015/0305432 A1 10/2015 Wiens
2017/0360151 A1 12/2017 Pratt
2018/0110292 A1 4/2018 Beers et al.
2018/0289109 A1 10/2018 Beers et al.
2018/0295942 A1 10/2018 Drake

FOREIGN PATENT DOCUMENTS

CN 201005111 1/2008
DE 19534249 3/1997
DE 19611797 10/1997
DE 29809404 8/1998
DE 10247163 10/2002
DE 102004005288 8/2005
EP 1059044 12/2000
GB 2517399 8/2013
JP 181910 6/1989
JP 2001149394 6/2001
JP 2006055571 3/2006
WO 2007080205 7/2007
WO 2009089572 7/2009
WO 2017004135 1/2017

OTHER PUBLICATIONS

Office Action dated Apr. 10, 2015 in U.S. Appl. No. 13/509,780.
Final Office Action dated Oct. 27, 2015 in U.S. Appl. No. 13/509,780.
Office Action dated Apr. 13, 2016 in U.S. Appl. No. 13/509,780.
Final Office Action dated Oct. 11, 2016 in U.S. Appl. No. 13/509,780.
Advisory Action dated Mar. 30, 2017 in U.S. Appl. No. 13/509,780.
Office Action dated Nov. 7, 2013 in Canadian Application No. 2,784,281.
Office Action dated May 19, 2017 in U.S. Appl. No. 13/509,780.
Office Action dated May 23, 2014 in Chinese Application No. 201080061183.8.
Office Action dated Oct. 15, 2013 in Japanese Application No. 2012-539036.
Office Action dated May 13, 2014 in Japanese Application No. 2012-539036 (English translation not available).
Notice of Allowance dated Mar. 3, 2015 in Japanese Application No. 2012-539036.

(56) References Cited

OTHER PUBLICATIONS

International Search Report and Written Opinion dated Feb. 23, 2011 in PCT Application No. PCT/US2010/056608.
Office Action dated Jun. 16, 2017 in U.S. Appl. No. 15/493,582.
International Search Report and Written Opinion dated Aug. 22, 2017 in Application No. PCT/US2017/028774.
USPTO; Notice of Allowance dated Oct. 11, 2017 in U.S. Appl. No. 15/493,582.
European Patent Office, Examination Report dated Jan. 22, 2018 from EP Application 10 779 652.6-1011.
Examination Report dated Sep. 4, 2018 from EP Application No. 10779652.6.
USPTO; Notice of Allowance dated Dec. 26, 2017 in U.S. Appl. No. 13/509,780.
USPTO; Office Action dated May 16, 2018 in U.S. Appl. No. 15/934,740.
PCT; International Preliminary Report on Patentability dated Jun. 14, 2018 in Application No. PCT/2017/028774.
USPTO; Restriction Requirement dated Nov. 27, 2018 in U.S. Appl. No. 15/693,195.
USPTO; Final Office Action dated Oct. 9, 2018 in U.S. Appl. No. 15/934,740.
USPTO; Non-Final Office Action dated Mar. 7, 2019 in U.S. Appl. No. 15/934,740.

* cited by examiner

RAPID-ENTRY FOOTWEAR WITH REBOUNDING FIT SYSTEM

CROSS-REFERENCE TO RELATED APPLICATIONS

This application is a continuation of, claims priority to and the benefit of U.S. Ser. No. 15/493,582 filed Apr. 21, 2017 and entitled RAPID-ENTRY FOOTWEAR WITH REBOUNDING FIT SYSTEM. The '582 application claims the benefit of U.S. Provisional Patent Application No. 62/368,497, filed Jul. 29, 2016 entitled "RAPID-ENTRY FOOTWEAR WITH REBOUNDING FIT SYSTEM," and U.S. Provisional Patent Application No. 62/326,650, filed Apr. 22, 2016 entitled "RAPID-ENTRY SHOE." All of the aforementioned applications are incorporated herein by reference in their entireties.

FIELD

The present disclosure relates to footwear, and more particularly to rapid-entry footwear with rebounding fit system.

BACKGROUND

Shoes come in a wide variety of shapes, sizes, functionalities, and purposes. While it is relatively easy to remove many types of shoes, it may not be so simple to put all such shoes back on again. Instead, many shoes require several steps to put the shoes on, including lacing and tying the shoes, using other fasteners, or the like, and such steps may include loosening and/or untying shoes that were not properly loosened or untied the last time the shoes were worn. In addition, many shoes require a shoe horn to make it easier to get the shoe on.

SUMMARY

Disclosed herein, according to various embodiments, is a rapid-entry and rebounding fit shoe having one or both of a rapid-entry heel structure and a rapid-entry tongue element, wherein both snap back for fit. The rapid-entry shoe directs a user's foot into or otherwise accommodates a user's foot with respect to, a shoe opening, and thereafter secures a rear portion of the rapid-entry shoe about a user's heel as well as forefoot.

The forgoing features and elements may be combined in various combinations without exclusivity, unless expressly indicated herein otherwise. These features and elements as well as the operation of the disclosed embodiments will become more apparent in light of the following description and accompanying drawings.

BRIEF DESCRIPTION OF THE DRAWINGS

The accompanying drawings are included to provide a further understanding of the present disclosure and are incorporated in, and constitute a part of, this specification, illustrate various embodiments, and together with the description, serve to explain the principles of the disclosure. In the drawings, only one shoe (either a left shoe or a right shoe) is illustrated. It is understood that the illustrated structure may be mirror-imaged to fit the opposite shoe.

Figure 1A:
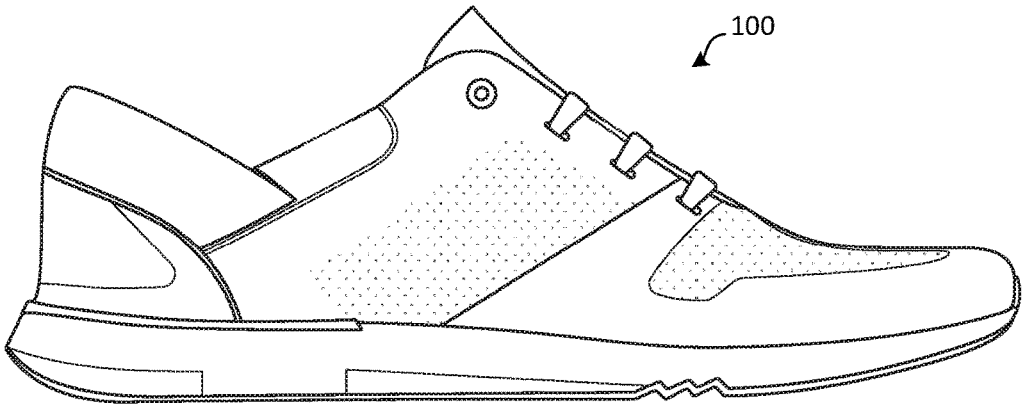
FIG. 1A illustrates a side view of a rapid-entry shoe in accordance with an example embodiment of the present disclosure.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, mechanical and structural changes may be made without departing from the spirit and scope of the disclosure. Thus, the detailed description herein is presented for purposes of illustration only and not of limitation.

For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, coupled or the like may include permanent (e.g., integral), removable, temporary, partial, full, and/or any other possible attachment option.

Any of the components may be coupled to each other via bolts, dowels, glue, stitching, welding, soldering, brazing, sleeves, brackets, clips or other manners known in the art or hereinafter developed. Additionally, any reference to without contact (or similar phrases) may also include reduced contact or minimal contact.

The present disclosure is directed toward rapid-entry footwear (e.g., a shoe) with rebounding fit system. The rapid-entry shoe, according to various embodiments, advantageously allows the user to put on and take off his or her shoes without the use of hands and/or without having to bend down to tie the laces, without having to use a shoe horn, or without using other such adjustment features, elements, or mechanisms for fit. In various embodiments, the rapid-entry shoe may include a one-time adjustment feature (e.g., an adjustment element that is not intended to be used each time a user puts on the rapid-entry shoe). For example, the rapid-entry shoe may include a hook-and-loop type fastener arrangement (e.g., Velcro®) that is intended to be adjusted upon purchase/initial use of the shoe. In another embodiment, a length or other dimension of one or more deformable elements may be adjusted/changed by a user to correspondingly adjust/change the circumference, tightness, or other dimension of the shoe opening. The rapid-entry shoe allows easy and rapid putting on and removal of the shoe and secures the shoe tightly and snugly to the user's foot. In some embodiments, the rapid-entry shoe does not include laces.

In various embodiments, the rapid-entry shoe includes one or both of a rapid-entry heel structure and a rapid-entry snap back fit tongue element. A rapid-entry heel structure, in turn, can include one or more anchors, deformable elements, and/or heel pieces, as described in greater detail below, while a rapid-entry tongue element can include one or more tongue flares, cross elements, and/or tongue stiffeners. Additional elements and features are disclosed for use in connection with the present disclosure. A rapid-entry shoe, in accordance with the example embodiments, easily allows or directs a user's foot into, or otherwise accommodates, a user's foot with respect to, a shoe opening. A rapid-entry shoe, as disclosed herein, can collapse when a user's foot enters the shoe opening and then rebound from a collapsed configuration to an uncollapsed configuration, to thereby secure a rear portion of rapid-entry shoe about a user's heel, quarter panel and/or in-step.

In discussing the illustrated embodiments of the rapid-entry shoe, certain directional words may be used. By way of example, words such as "right," "left," "front," "back," "forward," "backward," "rearward," "upper," "lower," "up," "down," and the like may be used to describe embodiments of the rapid-entry shoe. These words should be given meaning according to the manner in which a rapid-entry shoe is most typically designed for use, with the rapid-entry shoe on a user's foot and with the user's shod foot disposed on or ready for placement on an underlying surface. Thus, these directions may be understood relative to the rapid-entry shoe in such use. Similarly, as the rapid-entry shoe is intended primarily for use as footwear, words such as "inner," "inward," "outer," "outward," "innermost," "outermost," "inside," "outside," and the like should be understood in reference to a rapid-entry shoe's intended use, such that inner, inward, innermost, and the like signify relatively closer to the user's foot, and outer, outward, outermost, and the like signify relatively farther from the user's foot when the rapid-entry shoe is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

With reference now to FIG. 1A, as discussed above, example embodiments of the present disclosure include a rapid-entry shoe 100. While the rapid-entry shoe 100 is shown in the figures as a casual-type shoe, the rapid-entry shoe may be a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a flip flop, a boot, or other suitable type of shoe. Additionally, rapid-entry shoe 100 may be sized and configured to be worn by men, women, and children.

Figure 1B:
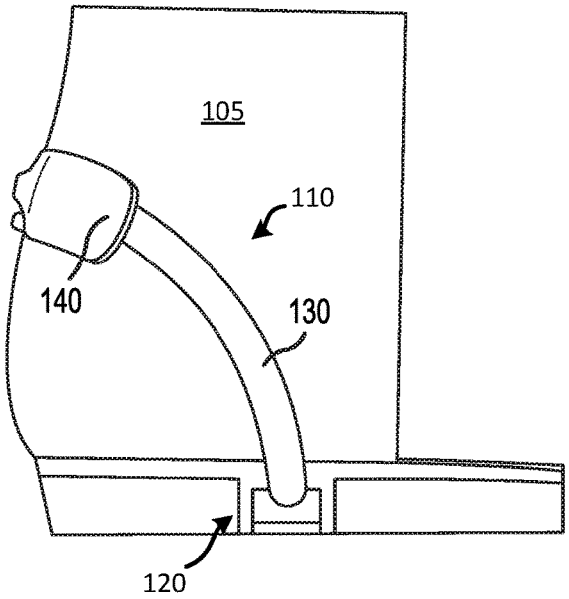
FIG. 1B illustrates a rapid-entry heel element in accordance with an example embodiment of the present disclosure.

Rapid-entry shoe 100 can include a rapid-entry heel structure 110, as referenced in FIG. 1B. Heel structure 110 is generally any structure, assembly, or mechanism configured to return a rear portion 105 of rapid-entry shoe 100 from a collapsed configuration to an uncollapsed configuration (as described in greater detail below), according various embodiments. As used herein, a rear portion 105 of rapid-entry shoe 100 can refer to the quarter of the shoe, a heel portion of the upper of the shoe, the heel seat, the heel counter, the back strap (e.g., in the case of a sandal), or other portion of the shoe that is configured to be disposed around a heel of a user. As described in greater detail below, at least a portion of the heel structure 110 (such as the deformable element 130 described below) is embedded within and/or extends along the rear portion 105 of the rapid-entry shoe 100.

In this regard, heel structure 110 can, itself, have a collapsed configuration 136 (momentary reference to FIGS. 3B and 3C) and an uncollapsed configuration 138 (momentary reference to FIGS. 3B and 3C), according to various embodiments. In example embodiments, and with reference to FIGS. 1A, 1B, 3B, and 3C, heel structure 110 is biased toward an uncollapsed configuration. In the uncollapsed configuration 138, heel structure 110 can secure a rear portion 105 of rapid-entry shoe 100 about a user's heel. Said differently, in example embodiments, the heel structure 110 is collapsed downward (i.e., towards the sole of the rapid-entry shoe 100) in the collapsed configuration 136, and the heel structure 110 is returned upward (i.e., away from the sole of the rapid-entry shoe 100) in the uncollapsed configuration 138 so as to extend around a user's heel. In various embodiments, while the compression of the heel structure 110 is greater in the collapsed configuration 136 than in the uncollapsed configuration 138, the uncollapsed configuration 138 of the heel structure 110 may still be at least partially compressed (i.e., preloaded compression) so as to be able to hold the rear portion 105 of the rapid-entry shoe 100 about the heel of the user. For example, the rear portion 105 of the shoe may hold or retain the heel structure 110 in the preloaded, uncollapsed configuration. In various embodiments, in the uncollapsed configuration 138 the heel structure may be disposed in a more upright/vertical orientation and/or may have little to no compression.

In a collapsed configuration, heel structure 110 can direct a user's foot into, or otherwise accommodate a user's foot with respect to, a shoe opening. The collapsed configuration can be caused by the user's foot pushing against or downward on heel structure 110 while at the same time expanding a shoe opening using, for example, a goring element or panel 170 (as described below with reference to, for example, FIG. 6A). In various embodiments, heel structure 110 in the collapsed configuration is pushed downward or is deformed and a shoe opening is expanded by at least about 5%, or at least about 10%, or at least about 15%. For example, a circumference of the shoe opening may be expandable by at least about 1.0 inch (about 2.54 centimeters). By way of illustration, and with momentary reference to the arrows depicted in FIG. 6E, the shoe opening may expand in response to the downward collapse of the rear portion of the rapid-entry shoe.

The amount of the expansion of the shoe opening can vary with the shoe style and size. In various embodiments, the rear portion 105 in the collapsed configuration is pushed downward or is compressed. In various embodiments, the heel height in the collapsed configuration is about 50% lower than the heel height in the uncollapsed configuration, however, as with other parameters, this may vary depending on the shoe style and size.

Once the user's foot is within rapid-entry shoe 100 or removed from rapid-entry shoe 100, the heel structure 110 returns to the uncollapsed configuration (i.e., its original position). In a collapsed configuration of example embodiments, heel structure 110 exhibits a return force toward an uncollapsed configuration of between about 1 pound-force and about 10 pound-force. In various embodiments, in a collapsed configuration the heel structure 110 exhibits a return force toward an uncollapsed configuration of between about 4 pound-force and about 8 pound-force. In various embodiments, in a collapsed configuration the heel structure 110 exhibits a return force toward an uncollapsed configuration of between about 5 pound-force and about 7 pound-force.

In various embodiments, the return force is strong enough such that the rear portion 105 of the shoe rebounds back up and snugly fits around the user's heel. In example embodiments, heel structure 110 returns from a collapsed configuration to an uncollapsed configuration in less than about 1 second. In various embodiments, the heel structure 110 returns from a collapsed configuration to an uncollapsed configuration in less than about 0.5 seconds. In various embodiments, the heel structure 110 returns from a collapsed configuration to an uncollapsed configuration in less than about 0.2 seconds. This rebound time is measured absent any external forces, e.g., as may be imparted by the user's heel.

Heel structure 110 can be manufactured as a standalone product, for incorporation into finished shoes, or can be manufactured to be integral with or within finished shoes.

In various embodiments, and with continued reference to FIG. 1B, the heel structure 110 of the rapid-entry shoe 100 comprises at least one base 120 and at least one deformable element 130. The deformable element 130 is coupled to the base 120 and is generally embedded within and/or is coupled to and extends along the rear portion 105 of the rapid-entry shoe 100. While a single deformable element 130 may extend continuously about the rear portion 105, the heel structure 110 may include a heel piece 140 positioned between two separate and distinct deformable elements 130, according to various embodiments described below. As used herein, the term "deformable element" refers to a resiliently flexible member that can be bent or compressed but has a bias to move towards a non-bent or uncompressed state. Additional details pertaining to the deformable element 130 are included below.

The deformable element(s) 130 is/are coupled to the base 120, according to various embodiments. The term "base" may refer to a rigid portion or section of the rapid-entry shoe 100 to which the deformable element(s) 130 is/are coupled. Said differently, the base 120 refers to an anchoring connection point(s) to which the deformable element(s) 130 is/are coupled. The base 120 may refer to an outsole or portions thereof, a midsole or portions thereof, an insole or portions thereof, a wedge or portions thereof, the upper or portions thereof (e.g., a heel counter), or other suitable structure disposed between and/or adjacent to these listed parts of the rapid-entry shoe 100.

Figure 8:
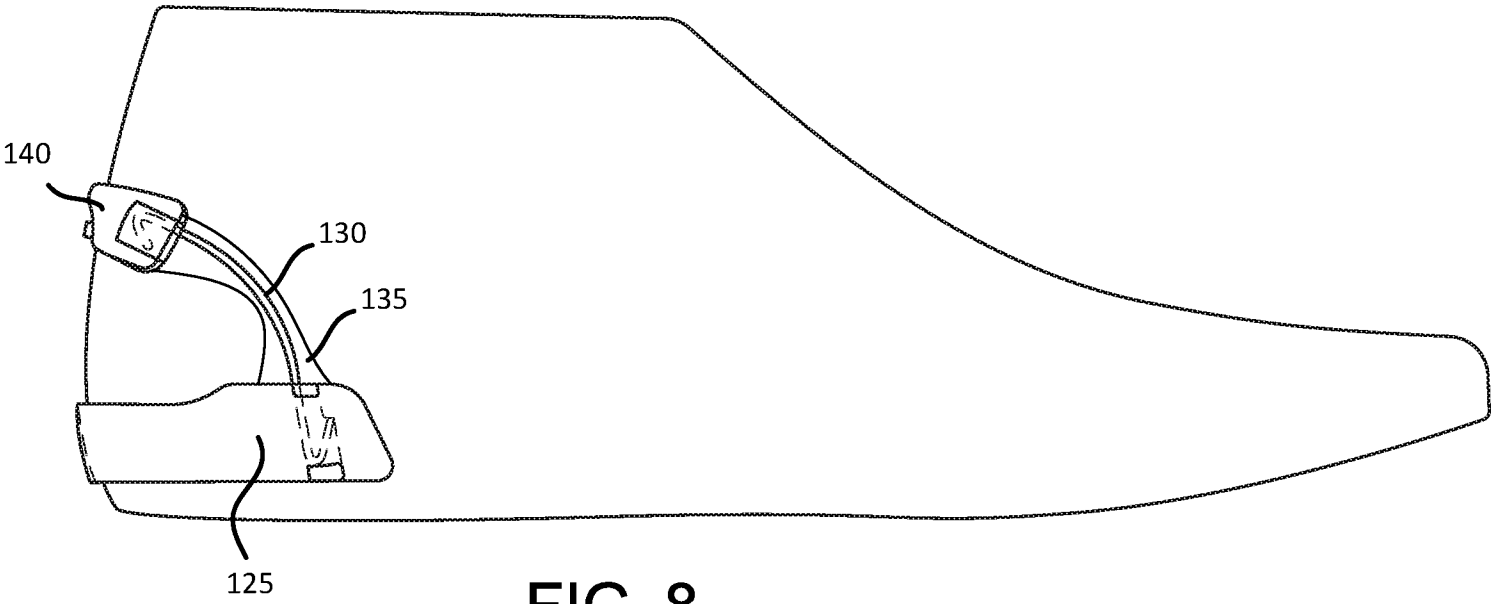
FIG. 8 illustrates a wire anchored in a heel counter where the heel counter is shaped to allow collapse of the heel in accordance with an example embodiment of the present disclosure.

While in various embodiments the deformable element 130 is directly coupled, mounted, or attached to the base 120, in other embodiments the base 120 may optionally include one or more anchors 121. In various embodiments, the anchor 121 may be a portion of the base 120 that engages and retains the deformable element(s) 130 in place. In various embodiments, the anchor(s) 121 can be integrally formed with, coupled to and/or located within or between, or outside of an insole, midsole, outsole, upper, or other rear portion 105 of rapid-entry shoe 100. In various embodiments, for example, the anchor 121 is disposed in a block or a wedge. Anchor 121 can be located in the upper, in the heel counter 125 (with reference to FIG. 8) or other device located above the outsole. Anchor 121 also can be located between the midsole and the outsole, between the footbed and the midsole, and/or outside the upper. In an embodiment, the midsole can be carved or cut out to attach or house anchor 121 to the rapid-entry shoe 100. Anchor 121 may also be attached to or in the heel counter 125. FIG. 8 illustrates a wire anchored in a heel counter 125 where the heel counter 125 is shaped to allow collapse of the heel in accordance with an example embodiment of the present disclosure. In various embodiments, the base 120 of heel structure 110 can include a single anchor 121 extending the full width of rapid-entry shoe 100 or the base 120 may include two anchors on opposing sides (e.g., lateral and medial) of the rapid-entry shoe 100.

Figure 2A:
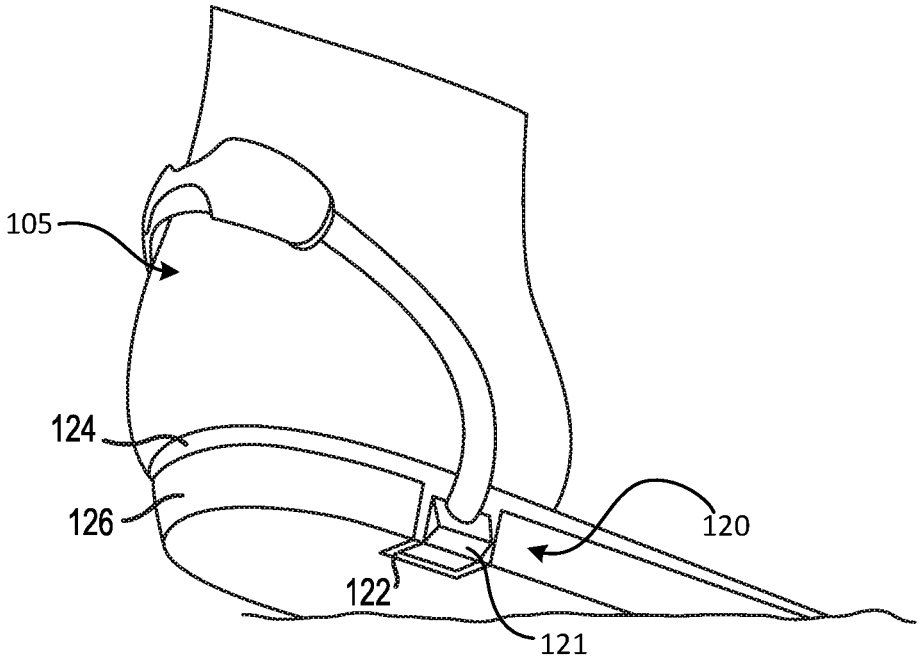
FIGS. 2A and 2B illustrate anchors in accordance with an example embodiment of the present disclosure.
Figure 2B:
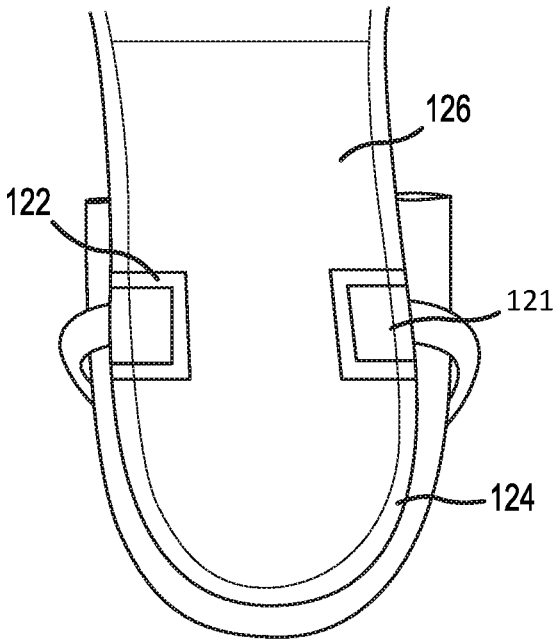

Anchor 121 is generally a structure provided to secure deformable elements 130 and/or heel pieces 140 to rapid-entry shoe 100. For example, and with reference to FIGS. 2A and 2B, the base 120 may include an anchor 121 and an anchor receptacle 122. Said differently, the anchor 121 can be seated in the anchor receptacle 122 formed by an extension of a midsole tuck 124 into a midsole wedge or midsole block 126.

Anchor 121 can include one or more materials such as nylon, acetal homopolymer/polyoxymethylene, aluminum, graphite, thermoplastic polyurethane (TPU), thermoplastic copolyester elastomer (TPC-ET), polypropylene, acrylic resin, rubber, titanium, acrylonitrile butadiene styrene (ABS), and polycarbonate.

Deformable element 130, as briefly introduced above, is generally a structure provided to return heel structure 110 from a collapsed configuration to an uncollapsed configuration. Heel structure 110 can include one or more deformable elements 130, for example, one on either side of rapid-entry shoe 100. As an example, a single deformable element 130 can travel from one side of shoe 100 to the other side of shoe 100 and can be attached to one or more anchors 121.

Deformable element 130 can include one or more of a tube, a wire, a spring, a shape memory structure or material, and the like. In example embodiments, deformable element 130 includes a single, unitary piece. For instance, and according to various embodiments, a first end of deformable element 130 can be embedded in or attached to a left anchor 121 (or the left side of a unitary anchor 121), a second end of deformable element 130 can be embedded in or attached to a right anchor 121 (or the right side of a unitary anchor 121), and a middle portion of deformable element 130 can extend around the heel (or be coupled to or be embedded within a heel piece 140), according to various embodiments.

In various embodiments, the first and second ends of the deformable element 130 are disposed below the footbed of the rapid-entry shoe 100. Said differently, the connection locations (e.g., anchors 121) of the base 120, to which the deformable element 130 is connected, are positioned below the footbed of the rapid-entry shoe 100. In various embodiments, the heel structure 110 may be configured so rear portion 105 remains positioned above the footbed of the rapid-entry shoe 100 at all times. Said differently, regardless of whether the heel structure 110 is in the collapsed configuration 136 or the uncollapsed configuration 138, rear portion 105 may remain above the footbed of the rapid-entry shoe 100, according to various embodiments.

Figure 3A:
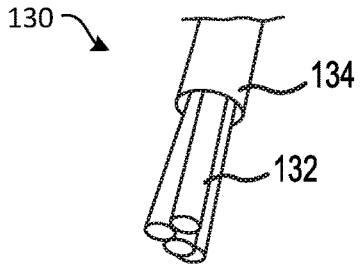
FIGS. 3A-3C illustrate deformable elements in accordance with an example embodiment of the present disclosure.

In other embodiments, deformable element 130 includes a plurality of separate and distinct components. For instance, deformable element 130 can include two separate components, with a first component having a first end embedded in or attached to a left anchor 121 (or the left side of a unitary anchor 121) and a second end embedded in or attached to the left side of heel piece 140 (or a left paddle of heel piece 140, as described below), and with a second component having a first end embedded in or attached to a right anchor 121 (or the right side of a unitary anchor 121) and a second end embedded in or attached to the right side of heel piece 140 (or a right paddle of heel piece 140, as described below). The plurality of separate and distinct components can be secured together, for example, with one or more of a tape wrap, woven encasing, overmold (e.g., TPU), heat shrink tube, and the like, each of which can provide different stabilities and strengths. By way of non-limiting example, and with reference to FIG. 3A, deformable element 130 can include one or more wires 132 encased or encased together in a cover, sleeve, overmold, or heat shrink tube 134. The one or more wires 132 can arch, bend and sway and then return to its initial/normal state.

Deformable element 130 can have variable mechanical properties along its length and/or at distinct points along its length. Such variation can be provided by deformable element 130, one or more of its plurality of separate and distinct components, and/or a securement surrounding all or a portion of deformable element(s) 130, having a variable cross-section, density, material, and/or the like along its length. A variable cross-section, in turn, can be provided by variation in thickness or shape, or twisting of deformable element 130 otherwise having a constant thickness or shape along its length. In various embodiments, the plurality of deformable elements 130 can comprise the same or different mechanical properties, for example, they can flex independent of each other.

In various embodiments, and with momentary reference to FIG. 8, the deformable element 130 includes a cover, sleeve, overmold, or other suitable structure (schematically shown as element 135). This cover 135 can protect the deformable element 130 and may control, guide, support and/or otherwise affect the flexure or compression of the deformable element 130. In various embodiments, the cover 135, based on its material of manufacture, shape, geometry etc., is configured to facilitate mechanical stress distribution by transferring mechanical bending/deforming forces from the deformable element 130 to the cover 135 to prevent or at least inhibit the deformable element from damage or breakage that may otherwise result from the concentrated and repeated mechanical stress experienced by the deformable element 130. For example, the cover 135 may have dimensions that vary along its length, such as the funnel-like tapering shape shown in FIG. 8, to help distribute stress and contribute to the dynamic flexing of the deformable element 130. In the rare event that the deformable element 130 breaks, the cover 135 may provide at least some degree of bias, thereby still enabling a certain level of rebound to help the entry shoe 100 return to the uncollapsed position. Further, the cover may provide additional padding and/or support to the deformable element and may prevent or at least inhibit the user from feeling the deformable element extending around the heel.

Deformable element 130 can further have directional biases. Such biases can be provided as described above, by deformable element 130, one or more of its plurality of separate and distinct components, and/or a securement surrounding all or a portion of deformable element(s) 130, having a variable cross-section, density, material, and/or the like along its length. By way of non-limiting example, deformable element 130 can include a first component or wire (e.g., nitinol) that is sufficiently resiliently flexible to return heel structure 110 from a collapsed configuration to an uncollapsed configuration, and can further include a second component or wire (e.g., graphite) that directs one or more desired arc(s) of curvature of deformable element 130 (e.g., an arc viewed from a side of a shoe, and an arc viewed from an end of a shoe). These two components can be covered or encased with a plastic coating or shield, as described above, as will be described in greater detail below with reference to FIG. 8. The heel structure 110 can be collapsed by a user's foot depressing down on it from the sides or the rear heel of the rapid-entry shoe 100. The heel structure 110 can be depressed off-center (e.g., from the sides) and still work and rebound properly.

Figure 3B:
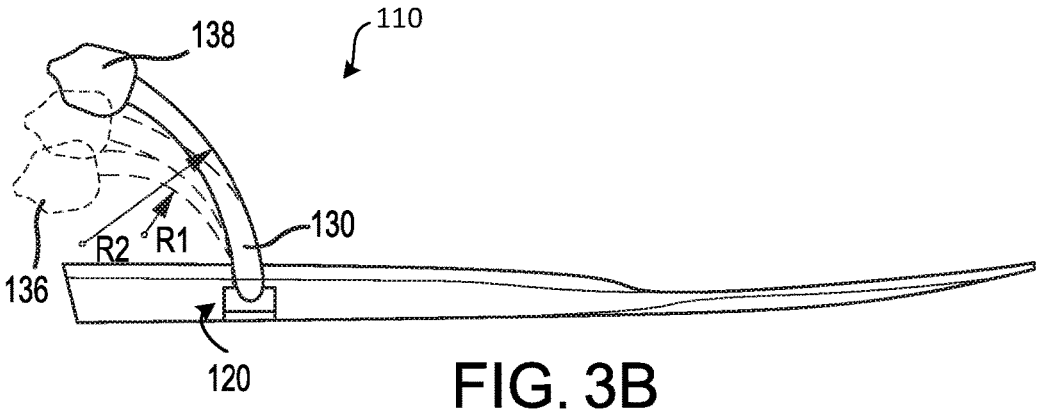
Figure 3C:
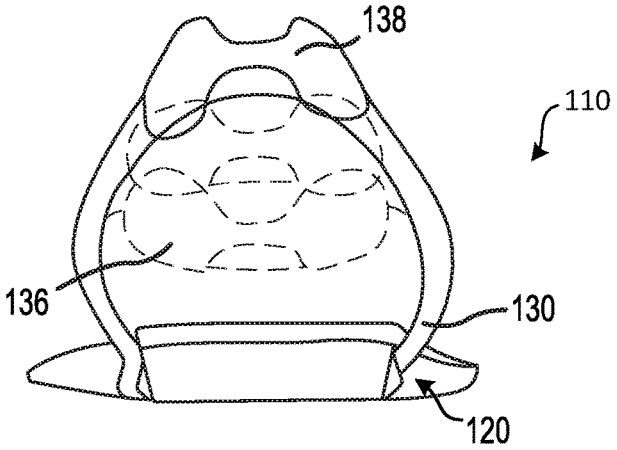

With reference to FIGS. 3B and 3C, deformable element 130 can exhibit one or more desired arc(s) of curvature as heel structure 110 moves between an uncollapsed configuration 138 and a collapsed configuration 136. For example, deformable element 130 can comprise a first arc of curvature viewed from a side of a shoe (FIG. 3B), and a second arc of curvature viewed from an end of a shoe (FIG. 3C). In this regard, deformable element 130 is not planar in some embodiments.

An arc of curvature can originate from anchor 121, however, in example embodiments, deformable element 130 does not pivot (i.e., is non-pivoting) about the base 120 (e.g., about an insole, midsole, or outsole) of the rapid-entry shoe 100. Said differently, the deformable element 130 may be non-rotatably coupled to the base 120. In various embodiments, engagement between the deformable element 130 and the base 120 (or anchor 121) is free of play, meaning that there is little or no relative movement between the two components 130, 120.

In some embodiments, an arc of curvature is constant along its length, while in other embodiments, an arc varies along its length and/or at distinct points along its length, for example, by exhibiting variable mechanical properties, as described above. In some embodiments, variation between an uncollapsed configuration and a collapsed configuration may be due to the constraints of the upper construction of the shoe.

With particular reference to FIG. 3B, an arc of curvature viewed from a side of a shoe exhibited by deformable element 130 can have a first radius of curvature R1 when heel structure 110 is in a collapsed configuration, and a second radius of curvature R2 (that is greater than first radius of curvature R 1) when heel structure 110 is in an uncollapsed configuration. In example embodiments, first radius of curvature R1 is about 30% to about 60% smaller, or about 45% smaller than second radius of curvature R2. In example embodiments, first radius of curvature R1 is 30% to 60% smaller than second radius of curvature R2.

Deformable element 130 can include one or more materials such as carbon steel, stainless steel, titanium, nickel titanium (nitinol) and other metals and alloys (shape-memory or otherwise), polymers (shape-memory or otherwise), composite materials, foam materials, graphite, carbon fiber, fiberglass, TPC-ET, silicone, TPU, and polycarbonate. For example, deformable element 130 can include titanium or be a titanium wire. Also, one or more deformable elements 130 can be made of a first material, e.g., titanium, and one or more deformable elements 130 can be made of a second material, e.g., graphite, which advantageously allow easier deformation of heel structure 110 while at the same time providing faster rebounding of heel structure 110 to its original position (i.e., the uncollapsed configuration).

Figure 3D:
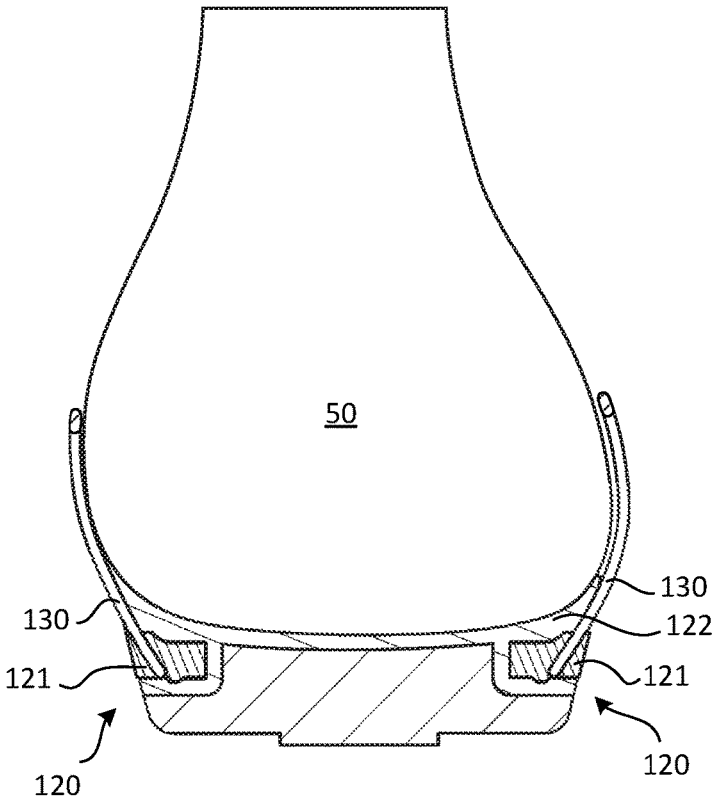
FIG. 3D illustrates a cross-sectional rear view of a deformable element engaged with an anchor, in accordance with various embodiments of the present disclosure.

In various embodiments, and with reference to FIG. 3D, the ends of the deformable element 130 that are mounted to the base 120 are oriented outwards at an angle relative to a vertical axis extending through the base 120. This angled orientation allows the deformable element 130 to extend around and/or follow the contours of the heel of the foot 50 of the user, according to various embodiments. The deformable element can be configured to follow natural contours of a user's foot/heel in the uncollapsed configuration and/or in the collapsed configuration. Accordingly, in various embodiments, the flexure, curvature, and/or length of the deformable element 130 on one side of the foot 50 (e.g., medial side) may be different than the curvature and/or length of the deformable element 130 on the other side of the foot 50 (e.g., lateral side).

At least a portion of the deformable element 130 may be connected to the rear portion 105 of the shoe. For example, the deformable element 130 may be coupled to the shoe in proximity to the topline of the shoe opening so that the rear portion 105 of the shoe collapses in response to the heel structure 110 changing to the collapsed configuration and the rear portion 105 of the shoe rebounds in response to the heel structure 110 reverting back to the uncollapsed configuration. In various embodiments, portions of the deformable element 130 may move within the rear portion 105 (e.g., the quarter) of the shoe. For example, the deformable element 130 may be disposed between, an inner surface and an outer surface of the quarter or heel counter of the shoe and, in response to deformation of the deformable element 130, may move relative to the inner and outer surfaces of the shoe. In example embodiments, the deformable element 130 or heel piece 140 can be completely contained within the rear portion 105 of the shoe 100. While the deformable element 130 is visible by a user in some embodiments, in other embodiments, the deformable element 130 is not visible by a user.

In various embodiments, and with reference to FIG. 3B, the deformable element 130 extends from the base 120 in an upwards and backwards (i.e., towards the rear portion 105 of the shoe) direction. This extension direction of the deformable element 130, according to various embodiments, prevents or at least inhibits the deformable element 130 from folding substantially inwards relative to the shoe opening in response to insertion of a user's foot. Said differently, while the deformable element 130 generally deforms and responds to a user's foot 50 being inserted into the shoe 150, the deformable element 130 generally prevents the topline (e.g., collar topline of shoe opening) from folding or bending inwards (i.e., prevents the shoe opening from substantially collapsing). In various embodiments, however, the deformable element 130 allows the shape of the rear portion of the topline of the shoe opening to deform and contour to the shape of the user's foot.

In various embodiments, as mentioned above, the base 120 may include an anchor 121 and an anchor receptacle 122. The anchor 121 may be able to be installed/coupled to the anchor receptacle 122, for example, via a resistance fit, compression fit, a snap fit, or via an interlocking mechanism/configuration. In such embodiments, the deformable element 130 may be first coupled to the anchor 121 and then the anchor 121 may be installed/coupled to the anchor receptacle 122.

Optional heel piece 140 is generally a structure provided to secure a rear portion 105 of rapid-entry shoe 100 about a user's heel when heel structure 110 is in an uncollapsed configuration, and direct a user's foot into, or otherwise accommodate a user's foot with respect to, a shoe opening when heel structure 110 is in a collapsed configuration. Heel structure 110 can include a plurality of heel pieces 140.

Figure 4A:
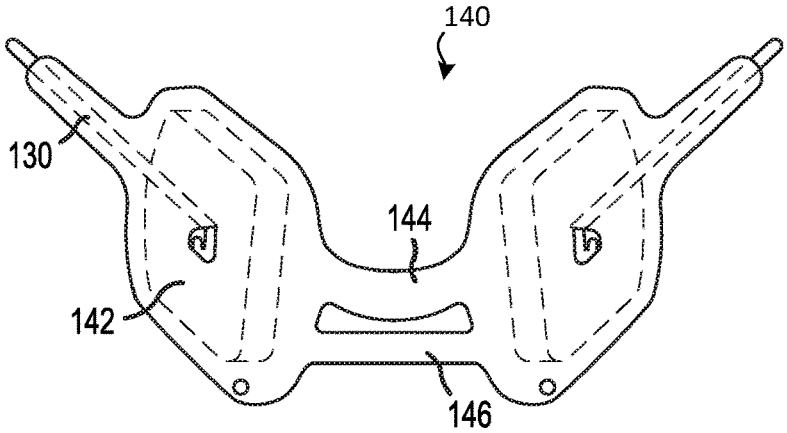
FIGS. 4A-4C illustrate heel pieces in accordance with an example embodiment of the present disclosure.
Figure 4B:
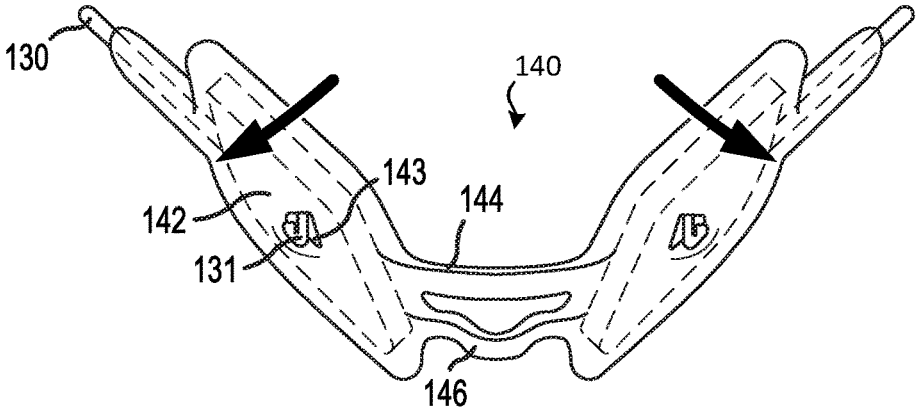

With reference to FIGS. 4A and 4B, heel piece 140 can include one or more paddles 142 that may be connected with one or more bridges or necks 144, 146. The bridges 144, 146 may be separated by a gap or an opening (as shown in FIGS. 4A and 4B). Paddles 142, in example, embodiments, are rotatable and/or moveable independent of each other. One or more paddles 142 connected with one or more necks 144, 146 can include a single, unitary piece, or a plurality of separate and distinct components, in some embodiments secured together, for example, with one or more of a tape wrap, woven encasing, overmold (e.g., TPU), heat shrink tube, and the like. Paddles 142 can also be joined together by the material making up the heel portion of the upper. The upper material can be used as the bridge and two separate, unconnected paddles can be used, according to various embodiments. Any kind of a cushioning system can be used as the paddles 142. The bridge 144, 146 can be a spring wire or an elastic, flexible, or pliable material that is connected to the two wires or wrapped around one wire. The deformable element 130 can be attached to only one anchor 121 and left unconnected at the other end, according to various embodiments. The paddles may be positioned within a quarter or heel counter of the rapid-entry shoe. In various embodiments, the paddles are connected to the rear portion of the rapid-entry in proximity to the topline of the shoe opening.

In example embodiments, no portion of any deformable element 130 extends completely through heel piece 140. Stated another way, in example embodiments, deformable element 130 is not continuous between medial and lateral sides of rapid-entry shoe 100. For example, paddles 142 can be rotatably coupled to deformable element 130. In various embodiments, the deformable element 130 can rotate to a certain degree about its longitudinal axis (e.g., torsion about is longitudinal axis). In other embodiments, the deformable element 130 extends completely through the heel piece 140 and/or forms the heel piece 140.

In some embodiments, lower bridge or neck 146 prevents inward rotation of paddles 142 about deformable element 130 (i.e., roll-in of paddles 142). More specifically, lower bridge or neck 146 can prevent the lower portions of paddles 142 from spreading apart. In example embodiments, a gap or opening is present between necks 144, 146. Alternatively, a single bridge or neck may be used to connect paddles 142.

Figure 4C:
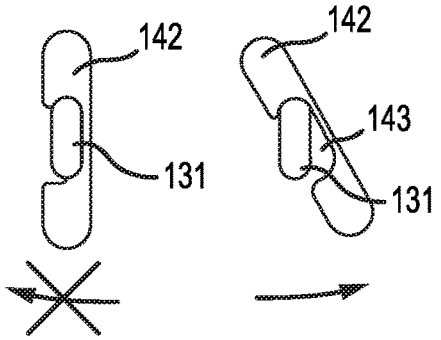
Figure 5:
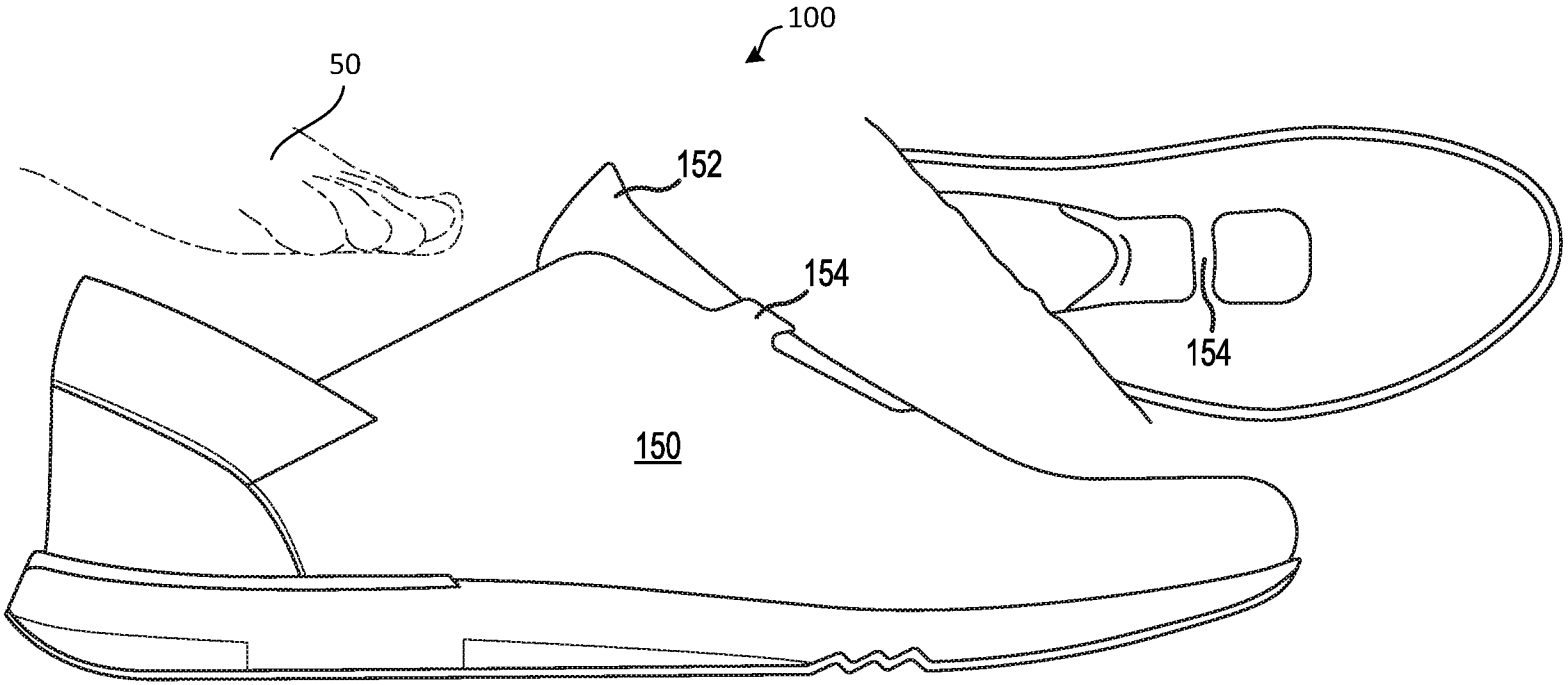
FIG. 5 illustrates side and top views of a rapid-entry tongue element in accordance with an example embodiment of the present disclosure.

Outward rotation of paddles 142 about deformable element 130 (i.e., flaring of paddles 142), as depicted by the arrows in FIG. 4B, is directed in example embodiments with a one-directional rotation feature. For example, and with reference to FIGS. 4B and 4C, paddle 142 can have an aperture 143, or increased internal volume on only one side into which an enlarged portion 131 of deformable element 130 can rotate in only one direction (e.g., an outward direction). Enlarged portion 131 can include a portion of deformable element 130 folded back on itself, a crimped portion of deformable element 130, or the like.

Figure 6A:
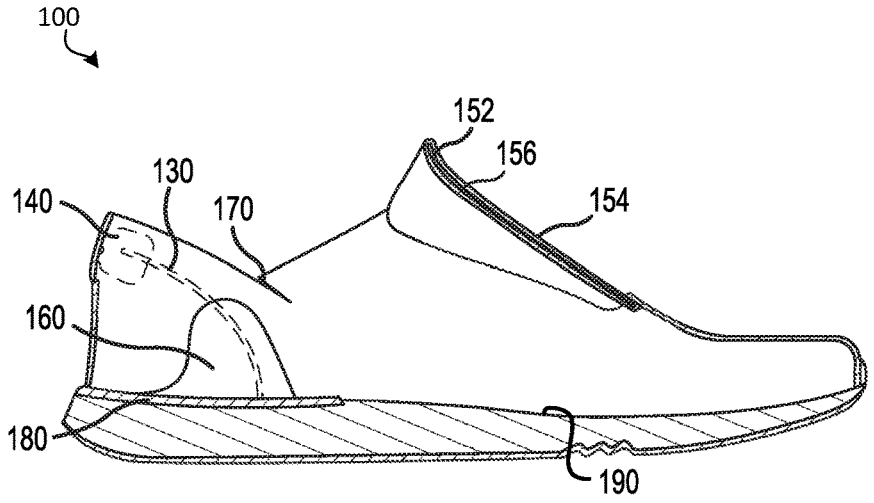
FIGS. 6A-6C progressively illustrate use of a rapid-entry shoe in accordance with an example embodiment of the present disclosure.
Figure 6B:
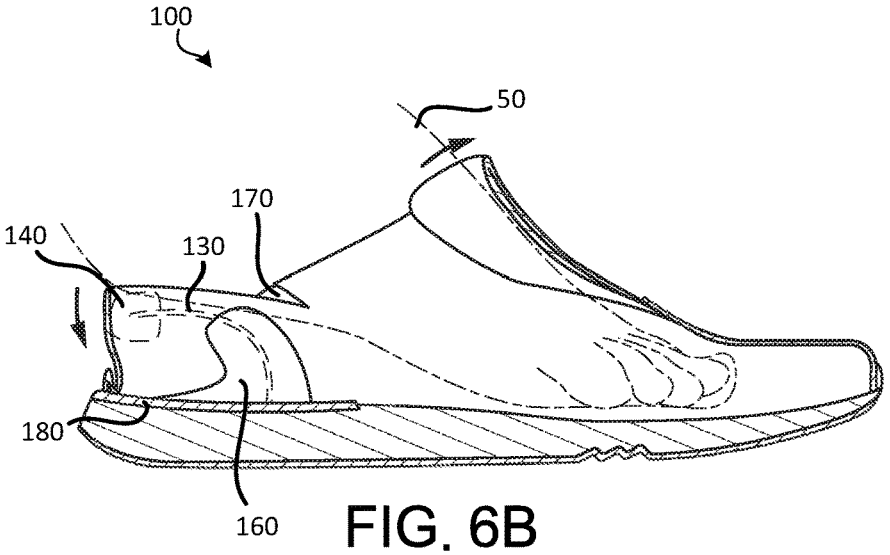

Outward rotation of a paddle of heel piece 140 about deformable element 130 can be further assisted by the collapsing of the heel piece or the heel material of the upper, as illustrated in FIG. 6B. In such embodiments, the collapsing of the heel material of the upper can cause a paddle of heel piece 140 to splay open.

Heel piece 140 can include one or more bendable or flexible materials such as thermoplastic rubber (TPR), silicone, styrene-ethylene/butylene-styrene (SEBS), nylon, acetal homopolymer/polyoxymethylene, aluminum, TPU, TPC-ET, polypropylene, acrylic resin, rubber, ABS, and polycarbonate.

Heel piece 140 may be manufactured of differing materials in the paddles 142 and necks 144, 146. Additionally, heel piece 140 may include differing layers of material to provide adequate stiffness and strength overall while providing a desired soft feel on the surfaces directed toward the user's foot or otherwise for the comfort of the user.

It will be evident to those skilled in the art that, in some embodiments, rapid-entry shoe 100 can have one or more traditional tightening/loosening features, such as laces, allowing a user to adjust the tightness of the fit of rapid-entry shoe 100. In addition to, or in lieu of such feature(s), and with reference to FIGS. 5 and 9A-9G, rapid-entry shoe 100 can include a rapid-entry and snap back fit tongue element 150 having one or more tongue flares 152, cross element 154, and/or tongue stiffeners. As used herein, a "cross element" can be a rigid, semi-rigid, or flexible element, for example, a strap, a bar, a gusset, or the like. In example embodiments, tongue flare 152 is shaped (e.g., funnel-like shape) to direct a user's foot 50 into rapid-entry shoe 100. Tongue element 150 may also move upward when pressure is applied by a foot entering or exiting the shoe. In various embodiments, the tongue element 150 is configured to buckle (e.g., bend, curve, bow) about the cross element 154. Said differently, the cross element 154 may facilitate bending of the tongue element 150 at a certain location along the length of the tongue element such that a top portion (e.g., the tongue flare 152) of the tongue element 150 bends to allow a user's foot 50 to enter the shoe while a lower portion (e.g., the portion below the cross element 154) remains unbent. The cross element 154 or other such feature may be coupled to, or may be part of, the quarter, the gusset, or other suitable portion of the shoe 150.

The cross element 154, in example embodiments, can be associated with the quarter of rapid-entry shoe 100, either as a separate panel or integrally formed as part of the quarter. The cross element 154 can also be a lace, webbing or other material sewn into or movable in the upper. In general, cross element 154 provides a semi-rigid area for the tongue to flex around when pushed outward by a user's foot entering rapid-entry shoe 100. In some embodiments, cross element 154 may be adjustable up and/or down to vary the amount of flex allowed to the tongue and to adjust the tightness of the fit. Adjustment up and/or down can be accomplished with a slide mechanism. In example embodiments, once an appropriate flex or tightness is achieved, cross element 154 is only rarely used. In another embodiment, there is no cross element. Instead, the vamp of the shoe extends up to a desired location on the tongue and performs the same function as the cross element 154.

With reference now to FIG. 6A, a tongue stiffener 156 can include a flexible, spring-like material, for example plastic or another flexible, semi-rigid material. In example embodiments, tongue stiffener 156 flexes outward and/or upward when pushed by a user's foot entering rapid-entry shoe 100. In such embodiments, tongue stiffener 156 then rebounds to a closed position after a user's foot has entered rapid-entry shoe 100. In some embodiments tongue stiffener 156 is visible on the tongue, while in other embodiments tongue stiffener 156 is sewn into the interior layers of the tongue.

In various embodiments, a rapid-entry shoe of the present disclosure can include one or more collapse elements and/or additional features described below with continued reference to FIG. 6A.

In some embodiments, rapid-entry shoe 100 includes a heel or material stiffener 160. The welded TPU protects the user and the liner material from rubbing against the wire. In example embodiments, heel or material stiffener 160 directs collapse of a more flexible heel material for consistent collapse. Material stiffener 160 can be shaped to flare at its widest point as the heel collapses, guiding the more flexible heel material to fold inward in a controlled way. Material stiffener 160 can be raised above the shoe outsole of a rear portion 105 of rapid-entry shoe 100, providing resistance and further guiding the more flexible heel material to fold inward. Material stiffener 160 can be applied to an outer or inner surface of rapid-entry shoe 100, or anywhere there between. Material stiffener 160 can include a TPU weld, a backing or the like. Alternatively, and with momentary reference to FIGS. 7A and 7B, the quarter panels of rapid-entry shoe 100 can extend to a rear portion 105 of rapid-entry shoe 100 to provide a structure and function substantially similar to material stiffener 160.

Figure 7A:
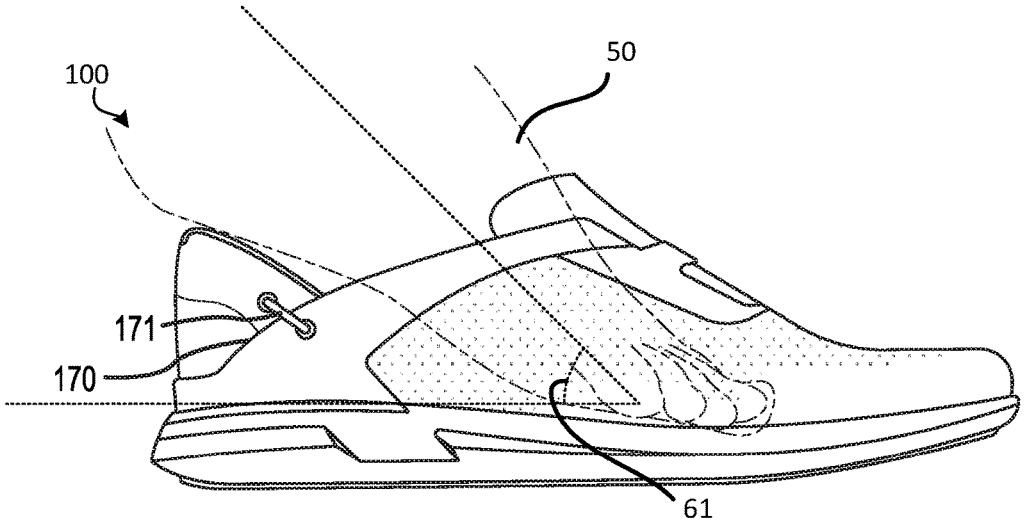
FIGS. 7A-7C illustrate a rapid-entry shoe in accordance with another example embodiment of the present disclosure.
Figure 7B:
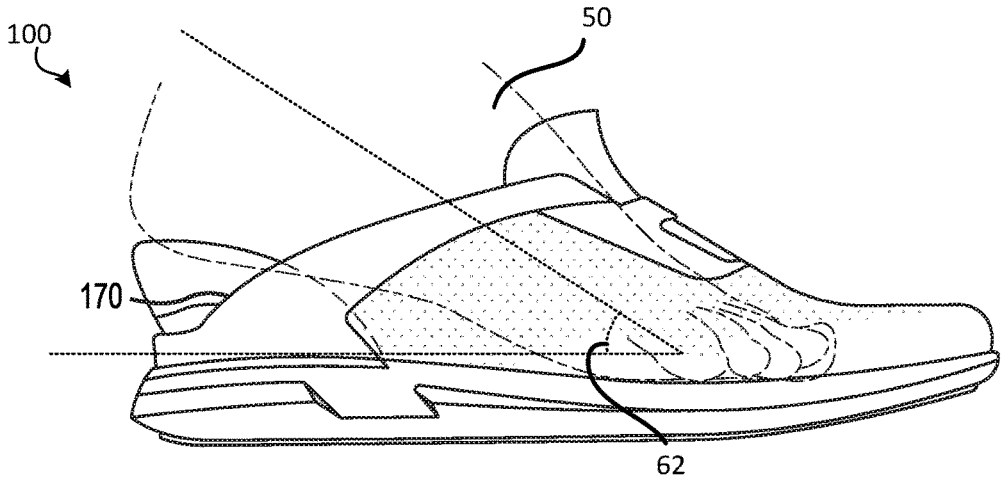
Figure 7C:
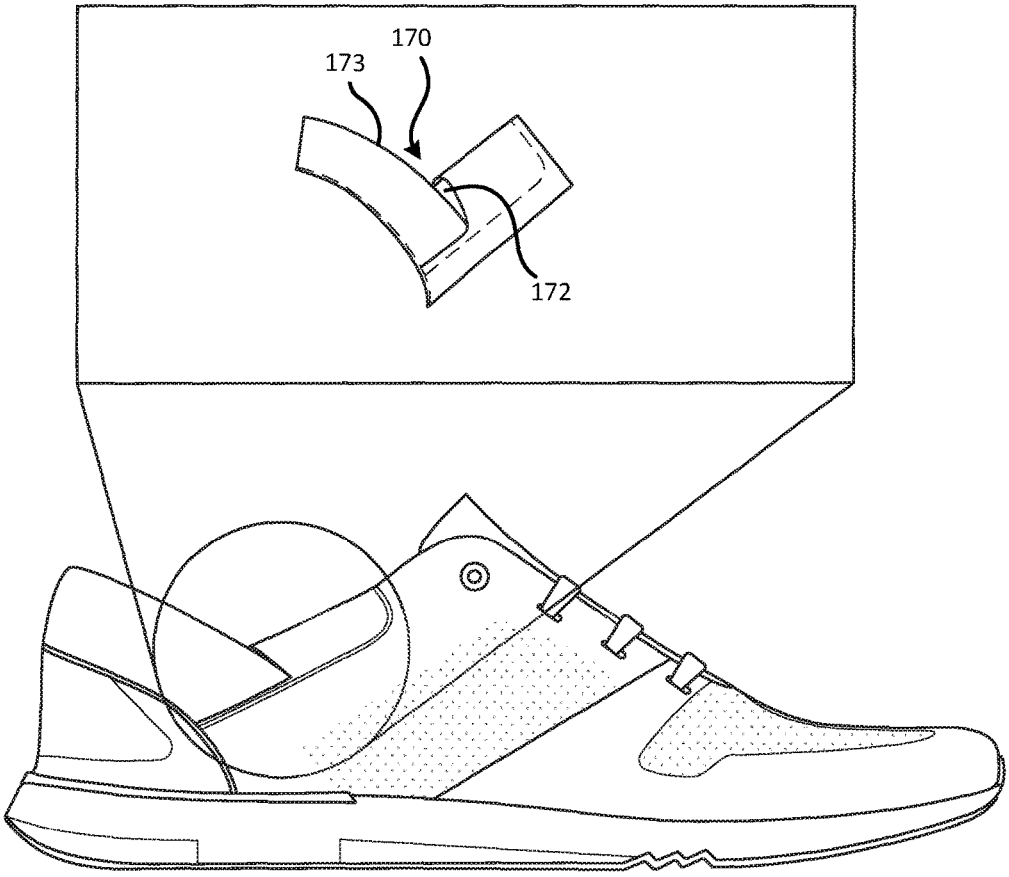

FIG. 7C illustrates an exploded view of a split 170 and an elastic gore 172 in the top rim of the rapid-entry shoe in accordance with an example embodiment of the present disclosure. Rapid-entry shoe 100 includes a split 170 formed in the shape of a triangle in some embodiments. In example embodiments, split 170 includes a split in the top rim, heel or rear of rapid-entry shoe 100, which can be in the lowest point of the collar topline 173 of rapid-entry shoe 100. Split 170 can include an elastic gore 172 or another stretchable material. In example embodiments, split 170 widens during heel compression, allowing the heel to collapse without pulling the lateral and medial quarters of rapid-entry shoe 100 inward. In another embodiment, and with momentary reference to FIGS. 7A and 7B, split 170 can distinguish a more substantially separated heel that moves independent of the quarter panels of rapid-entry shoe 100. Split 170 can be accompanied by an elastic member 171 (see FIG. 7A), to enhance the return of the heel to the quarter panels.

In various embodiments, and with reference to FIGS. 7A and 7B, the collapsibility of the rapid-entry shoe 100 enables the insertion angle of the foot 50 to be changed. As used herein, "insertion angle" refers to an angle between a longitudinal axis of the foot 50 and the longitudinal axis of the footbed of the shoe. FIG. 7A shows a first foot insertion angle 61 and FIG. 7B shows a second foot insertion angle 62 that is less than the first foot insertion angle 61. Without the collapsibility of the rapid-entry shoe 100, as provided herein, the user would not be able to change from the first foot insertion angle 61 to the second foot insertion angle 62 and thus would need to maintain the first foot insertion angle 61, or potentially increase the first insertion angle 61, in order to insert the foot 50 into the shoe. For example, using a conventional shoe the user may need to manually loosen shoe laces or may need to use a shoe horn in order to insert his/her foot into the conventional shoe. Accordingly, the heel mechanism 110 (e.g., including the deformable element 130) enables the foot insertion angle to be reduced, thereby improving the ease of putting on the rapid-entry shoe 100. Said differently, with user's foot 50 may deform the heel mechanism into the collapsed configuration, thereby allowing the instep and/or ball of the foot 50 to be lower during insertion. Once again, after completely inserted the foot 50 within the rapid-entry shoe, the heel mechanism 110 causes the rear portion 105 of the rapid-entry to rebound upwards around the heel for a snug fit.

In various embodiments, the split 170 does not extend along the entire height of the quarter/upper of the shoe. The split 170 may extend from about 30% to about 40% of the distance between the topline 173 and the footbed, however, as with other parameters, this may vary depending on the shoe style and size.

In some embodiments, rapid-entry shoe 100 includes a kick plate 180. In example embodiments, kick plate 180 is forms or is otherwise integral with the anchor receptacle 122 described above with reference to FIG. 3D. That is, in some embodiments, kick plate 180 can be configured to retain (or contribute to the retention of) an anchor 121. In various embodiments, the kick plate 180 (anchor receptacle 122) includes a widened portion on a medial or lateral side of the heel of rapid-entry shoe 100, providing a location for the toe of the opposite shoe to remove rapid-entry shoe 100 for hands-free operation. Kick plate 180 can include a TPU mold, nylon or other rigid material, a backing or the like, embedded into the midsole of rapid-entry shoe 100.

Figure 6C:
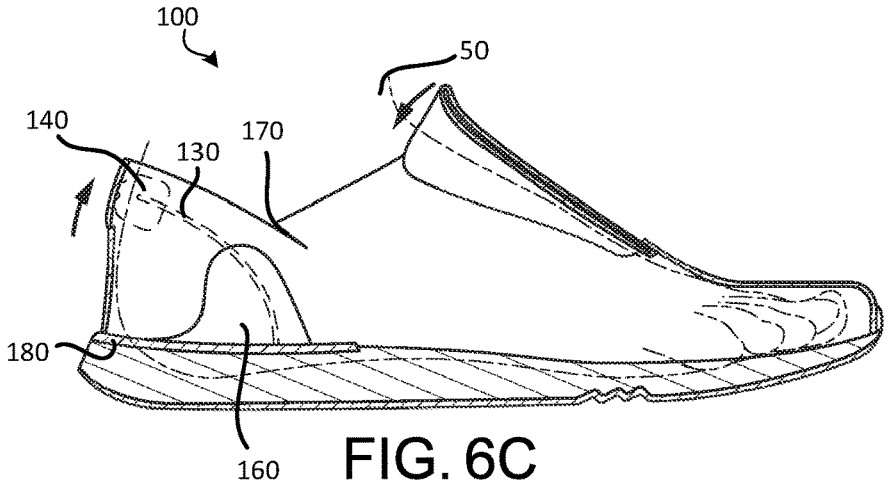
Figure 6D:
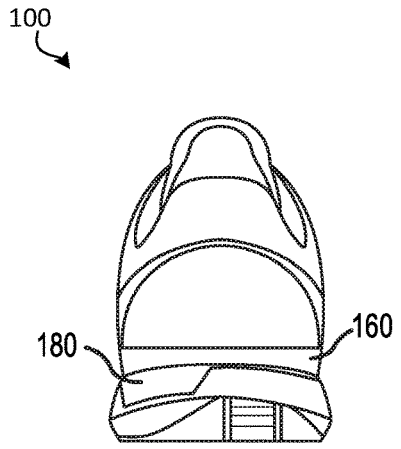
FIGS. 6D-6F illustrate rear views of FIGS. 6A-6C, respectively.

In accordance with example embodiments, as shown in FIGS. 6A-6C, rapid-entry shoe 100 may provide for wire protection, for example, a TPU weld, a backing or the like on a portion of the liner material to protect the liner and a user's foot from wire rub, and/or provide pressure dissipation to minimize hot spots.

Having described the numerous rapid-entry features of the present disclosure, FIGS. 6A-6F illustrate how the features provided by the heel element and the tongue element facilitate rapid entry and fit of a user's foot into rapid-entry shoe 100. In FIGS. 6A and 6B, rapid-entry shoe 100 is resting on an underlying surface, ready to receive a user's foot.

Figure 6E:
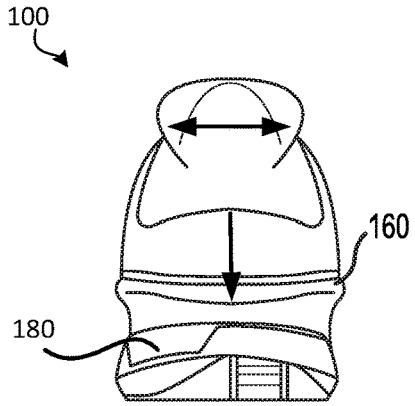

When the user wishes to put on rapid-entry shoe 100, he/she begins by inserting the user's foot into the traditional shoe opening, as shown in FIGS. 6B and 6E. Tongue flare 152 flares outward, increasing the size of the opening for the user's foot, to direct the user's foot into rapid-entry shoe 100. At the same time, tongue stiffener 156 flexes outward when pushed by the user's foot entering rapid-entry shoe 100 then the tongue snaps back down to fit over instep.

As the user's foot is inserted into rapid-entry shoe 100, the increasing amount of the user's foot in rapid-entry shoe 100 begins to press downward on the rear of the upper, causing it to deflect downward against the tension imparted to the rear of the upper by deformable element 130. As the user's foot nears full entry into rapid-entry shoe 100, the rear of the upper is almost fully depressed. Given the extent of deformation of the rear of rapid-entry shoe 100 in example embodiments, it will be appreciated that the materials of the quarter will generally be selected to permit a desired amount of deformation while maintaining a desired appearance. In some embodiment, the materials of the quarter are selected to direct or otherwise facilitate a desired deformation. For example, with continued reference to FIGS. 6B and 6E, material stiffener 160 can guide the more flexible heel material to fold inward in a controlled way. In the same or other embodiments, split 170 can widen during heel compression, allowing the heel to collapse without pulling the lateral and medial quarters of rapid-entry shoe 100 inward.

Figure 6F:
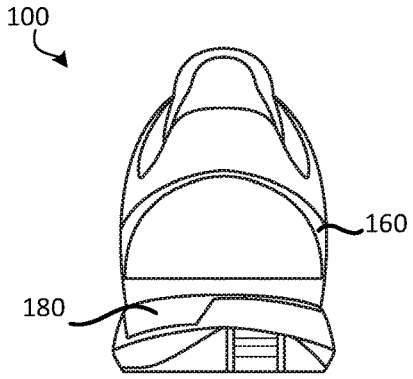

As the user's foot fully enters rapid-entry shoe 100, the tension in deformable element 130 causes the rear part of the upper to rebound upward around the user's foot, until rapid-entry shoe 100 again assumes its natural configuration, as shown in FIGS. 6C and 6F. Tongue stiffener 156 can then rebound to a closed position after the user's foot has entered rapid-entry shoe 100. Cross element 154 may be adjustable to vary the amount of flex allowed to the tongue and to adjust the tightness of the fit, similar to the one-time adjustment feature described above. In this configuration, rapid-entry shoe 100 naturally retains the user's foot in rapid-entry shoe 100 against unwanted removal. Slide zone 190 may allow a user's foot to slide on the footbed during entry.

The user can then wear rapid-entry shoe 100 as normal until the user wishes to remove rapid-entry shoe 100, at which time rapid-entry shoe 100 can be rapidly removed. While many shoes cannot be removed without being untied, the rapid-entry features provided by the heel element and the tongue element further facilitate removal. The user simply presses down on the kick plate 180 either with the other foot or with the hand or another object, greatly easing the foot's removal from rapid-entry shoe 100. In example embodiments, contact by the toe or other portion of the opposite shoe with kick plate 180 facilitates removal of rapid-entry shoe 100 for hands-free operation.

As the user's foot enters and leaves rapid-entry shoe 100, different portions of the user's foot contact heel piece 140. These different portions of the user's foot have different contours, and the construction of heel piece 140 allows heel piece 140 to deform and generally conform to the portion of the user's foot then contacting heel piece 140. For example, as the user's foot enters rapid-entry shoe 100 (e.g., as shown in FIGS. 6B and 6E), the paddles of heel piece 140 may rotate and splay about one or more necks and their connection to deformable element 130, so that the user does not feel like he/she is stepping on a narrow edge of the opening of rapid-entry shoe 100. Instead, the user feels a flat or gently sloping portion naturally receiving his or her foot. In contrast, when the user's foot is completely within rapid-entry shoe 100, the paddles of heel piece 140 rotate to a more vertical position and may draw together, more naturally embracing the area around the user's Achilles tendon. In various embodiments, the heel piece 140 may include a ledge or a lip that helps to retain the foot/heel within the shoe. This rotation improves the feel, fit, and security of rapid-entry shoe 100 once fully on the user's foot. Thus, the configuration of heel piece 140 greatly improves functionality, fit, and comfort of rapid-entry shoe 100.

Figure 9B:
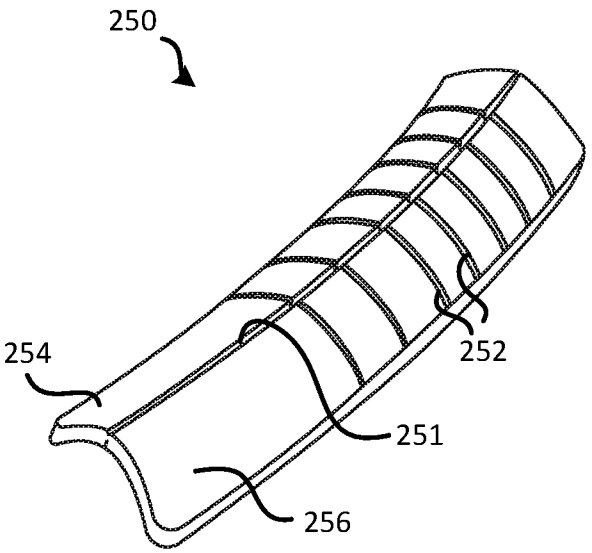
FIGS. 9A-9E illustrate various views of a rapid-entry with snap back fit tongue element in accordance with an example embodiment of the present disclosure.
Figure 9A:
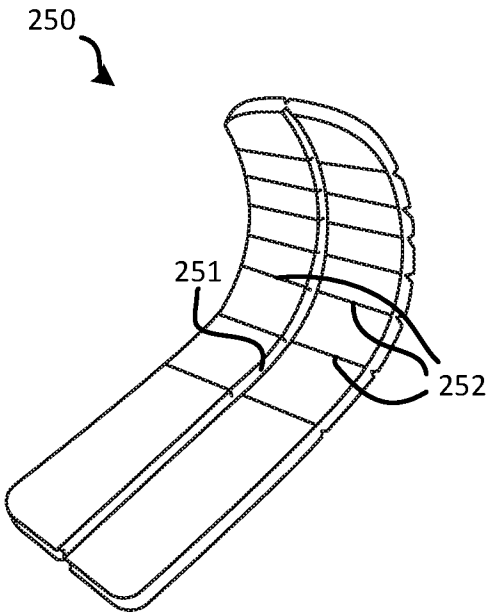

Referring to FIGS. 9A-9G, an exemplary rapid-entry snap back fit tongue element 250 is shown. The tongue element 250 may be made of a thermal plastic or nylon material. The tongue element 250 has a center channel 251 that travels along a length and a plurality of cuts or indentations 252 that travel along a width, according to various embodiments. The center channel 251 allows the tongue element 250 to bend into two side-by-side sections 254, 256 as shown in FIG. 9B. The plurality of cuts 252 allow for the tongue element to bend upward. As shown in FIG. 9A, the plurality of cuts 252 are spaced closer together at the front of the tongue element 250 and spaced farther apart at the back of the tongue element 250, according to various embodiments. These cuts and non-uniform spacing of the cuts advantageously allows for the tongue element 250 to provide a larger and steeper opening for easier access by the user's foot into the shoe and better stability when the user's foot is inside the shoe. The plurality of cuts 252 may also be spaced an equidistance apart from one another, according to various embodiments. When the user's foot 50 enters the rapid-entry shoe and upward pressure is applied by the foot to the front of the tongue element, the tongue element easily flexes upward and outward to further open and widen the shoe opening, with reference to FIG. 9A and according to various embodiments. When the foot is inside the rapid-entry shoe, the arch of the foot applies upward pressure on the underside of the tongue element causing the tongue element to flatten and then curve around the foot (e.g., the underside of the tongue element 250 may be concave in response to the foot 50 being within the shoe (see FIGS. 9B, 9C, 9E and 9G). The tongue element 250 pushes back down on the foot after the foot slides into the shoe, according to various embodiments. This advantageously allows for a snug and better fit. Also, the tongue element provides better flexibility and wearability.

Figure 9D:
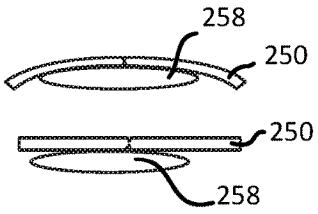
Figure 9E:
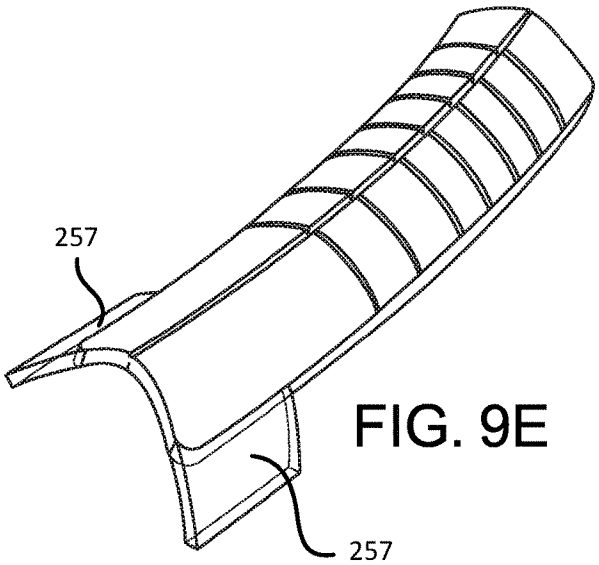
Figure 9C:
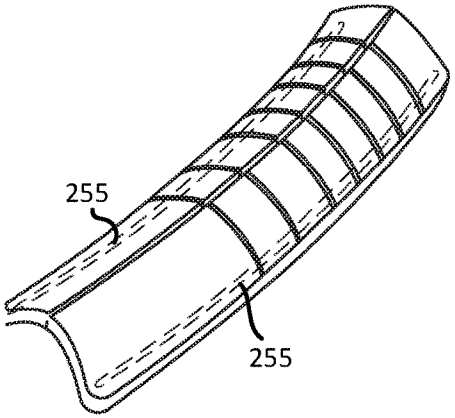
Figure 9F:
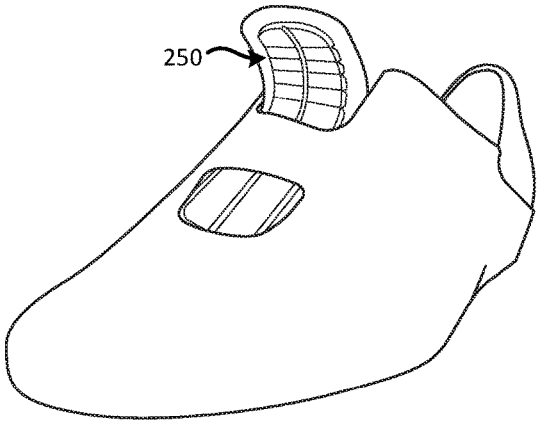
FIG. 9F illustrates a view of the rapid-entry with snap back fit tongue element as a foot of the user is being inserted into the rapid-entry shoe in accordance with an example embodiment of the present disclosure.
Figure 9G:
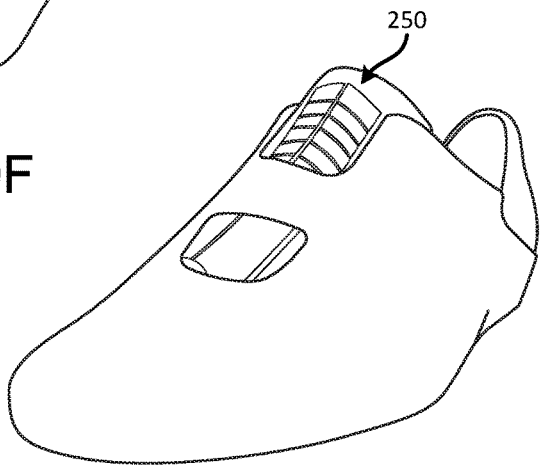
FIG. 9G illustrates a view of the rapid-entry with snap back fit tongue element when a foot of the user is located within the rapid-entry shoe in accordance with an example embodiment of the present disclosure.

According to various embodiments, and with reference to FIG. 9D, a cushion 258, such as a foam cushion, a gel element, an or liquid filled bag, etc., can be attached, coupled or positioned next to an underside of the tongue element 250 to allow for better comfort and to assist in keeping the tongue element 250 in a locked or secure position while the foot 50 is inside the shoe. In various embodiments, and with reference to FIG. 9C, one or more resiliently flexible wires 255 or straps can be embedded within or attached/coupled to the tongue element 250 to aid in the flex and snap back of the tongue element 250. The tongue element 250 can be covered by a canvas, leather or other material and/or can replace or be inserted into a standard shoe tongue to provide rapid-entry into the shoe. In various embodiments, the tongue element 250 may have flaps 257 or other flanges or extensions that contribute to the resilient flexibility of the tongue element 250.

It will be apparent to those skilled in the art that various modifications and variations can be made in the present disclosure without departing from the spirit or scope of the disclosure. For example, while the present disclosure has been described primarily with reference to shoes, those skilled in the art will understand that the disclosure may be applied to various apparatuses having foot restraints as integral components, for example, water skis. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A rapid-entry shoe comprising:

a heel piece comprising a first paddle and a second paddle, wherein the heel piece is located at a rear portion of the rapid-entry shoe;

a first anchor and a second anchor, each disposed beneath a footbed of the rapid-entry shoe, wherein the first anchor is disposed on a medial side of the rapid-entry shoe and the second anchor is disposed on a lateral side of the rapid-entry shoe;

a first deformable element coupled directly to the first anchor and extending between the first anchor and the first paddle; and a second deformable element coupled directly to the second anchor and extending between the second anchor and the second paddle;

wherein the shoe comprises a collapsed configuration and an uncollapsed configuration;

wherein in the collapsed configuration the first deformable element and the second deformable element are in a compressed state; and wherein in the uncollapsed configuration the first deformable element and the second deformable element are oriented upwards and are in a partially compressed state.

2. The rapid-entry shoe of claim 1, wherein the first deformable element is partially compressed in the uncollapsed configuration.

3. The rapid-entry shoe of claim 1, wherein the first deformable element exhibits a return force toward the uncollapsed configuration of between about 4 pound-force and about 8 pound-force.

4. The rapid-entry shoe of claim 1, wherein the first deformable element returns from the collapsed configuration to the uncollapsed configuration in less than about 0.2 seconds.

5. The rapid-entry shoe of claim 1, wherein an arc of curvature of the first deformable element comprises a first radius of curvature in the collapsed configuration and a second radius of curvature in the uncollapsed configuration, wherein the first radius of curvature is 30% to 60% smaller than the second radius of curvature.

6. A rapid-entry shoe, comprising:

a heel piece comprising a first paddle coupled to a second paddle, wherein the heel piece is located at a rear portion of the rapid-entry shoe, and wherein the first paddle is disposed on a medial side of the rapid-entry shoe and the second paddle is disposed on a lateral side of the rapid-entry shoe;

wherein the shoe comprises a collapsed configuration and an uncollapsed configuration;

wherein in the collapsed configuration the first paddle is rotated downward about a first axis of rotation and outward about a second axis of rotation and the second paddle is rotated downward about the first axis of rotation and outward about a third axis of rotation;

wherein in the uncollapsed configuration the first paddle is rotated upward about the first axis of rotation and inward about the second axis of rotation and the second paddle is rotated upward about the first axis of rotation and inward about the third axis of rotation;

wherein the first axis of rotation extends from the lateral side of the rapid-entry shoe to the medial side of the rapid-entry shoe; and wherein the second axis of rotation comprises a longitudinal axis of the first paddle and wherein the third axis of rotation comprises a longitudinal axis of the second paddle.

* * * * *